US005136490A

United States Patent [19]

Morrison

[11] Patent Number: 5,136,490

[45] Date of Patent: Aug. 4, 1992

[54] ELECTRIC LIGHT FIXTURE WITH ENHANCED HEAT DISSIPATION CAPABILITY

[75] Inventor: Richard D. Morrison, West Lafayette, Ohio

[73] Assignee: LSI Industries, Inc., Cincinnati, Ohio

[21] Appl. No.: 791,421

[22] Filed: Nov. 13, 1991

Related U.S. Application Data

[63] Continuation of Ser. No. 697,470, May 9, 1991, Pat. No. D. 324,113.

[51] Int. Cl.[5] ..... F21V 29/00

[52] U.S. Cl. ..... 362/294; 362/373

[58] Field of Search ..... 362/147, 263, 294, 345, 362/373, 404, 408; D26/72, 85, 87, 88, 90, 67

[56] References Cited

U.S. PATENT DOCUMENTS

| | | | |
|---|---|---|---|
| D. 200,069 | 1/1965 | Van Steenhoven . | |
| D. 201,151 | 5/1965 | Jackson . | |
| D. 207,414 | 4/1967 | Lum | D26/88 |
| D. 207,789 | 5/1967 | Kimble | D26/67 |
| D. 211,821 | 7/1968 | Pettengill . | |
| D. 213,994 | 4/1969 | Blaisdell et al. . | |
| D. 217,018 | 3/1970 | Anderson, Jr. . | |
| D. 226,534 | 3/1973 | Anderson, Jr. . | |
| D. 254,215 | 2/1980 | Yahraus et al. . | |
| D. 268,876 | 5/1983 | Leithauser | D26/72 |
| D. 269,639 | 7/1983 | Eargle, Jr. et al. . | |
| 3,404,269 | 10/1968 | Schiffer et al. . | |
| 3,432,629 | 3/1969 | Field et al. . | |
| 3,511,984 | 5/1970 | Blaisdell et al. . | |
| 3,662,165 | 5/1972 | Osteen et al. | 362/297 |
| 3,919,459 | 11/1975 | Van Steenhoven . | |
| 3,986,019 | 10/1976 | deVos et al. . | |
| 4,222,093 | 9/1980 | Garcia et al. . | |
| 4,286,313 | 8/1981 | Quiogue | 362/404 |
| 4,403,277 | 9/1983 | Eargle, Jr. et al. . | |
| 4,460,947 | 7/1984 | Kelly . | |
| 4,943,901 | 7/1990 | Baldwin et al. | 362/277 |

*Primary Examiner*—Richard R. Cole

*Attorney, Agent, or Firm*—Wood, Herron & Evans

[57] ABSTRACT

A light fixture includes, from top to bottom, a first elongated box-shaped housing with vertical side walls, a second box-shaped housing, a coil cover, a light socket and a reflector connected to the coil cover by a pair of spaced, vertical arms. The arms connect to horizontal slots formed in opposing vertical sides of the cover, each of the opposing vertical sides having a plurality of slots to provide selectability for vertically positioning the reflector. The cover also includes a pair of inclined surfaces extending between the slotted, opposing vertical sides. During operation, heat generated inside the cover flows outwardly through the horizontal slots. Heat also flows upwardly, deflects off the inclined surfaces of the cover, contacts the bottom of the first housing, and then flows around the side walls of the first housing to extract heat therefrom.

13 Claims, 2 Drawing Sheets

ELECTRIC LIGHT FIXTURE WITH ENHANCED HEAT DISSIPATION CAPABILITY

This application is a continuation of applicant's currently pending U.S. Ser. No. 07/697,470, filed on May 5, 1991 and entitled "Light Fixture" U.S. Pat. No. 0,324,113.

FIELD OF THE INVENTION

This invention relates to an electric light fixture. More particularly, this invention relates to a fixture for supporting a mercury vapor, metal halide or high pressure sodium lamp, wherein the enhanced heat dissipation capability.

BACKGROUND OF THE INVENTION

A fixture for supporting a mercury vapor, metal halide or high pressure sodium lamp generally includes a housing for a capacitor and an igniter, a transformer, a socket for supporting the bulb and a reflector surrounding the bulb. If hung from a ceiling, electrical leads extend through a conduit into the upper housing for connection to the igniter and capacitor. These components connect to the transformer, which is in turn electrically connected to the socket, which is generally located below the transformer.

In operation, heat is generated by the energized bulb and the transformer. Because all of the components of the fixture are susceptible to excessive heat build up, and excessive heat can cause shorter useful life, or in some cases, a potential fire hazard, this heat must be dissipated. To reduce heat build up at the bulb, some fixtures have an annular open space between the top of the reflector and the socket. This open space causes a chimney effect which allows heat to rise upwardly and away from the bulb and socket, rather than being trapped within the otherwise closed upper end of the housing.

While this chimney effect alleviates heat build up at the bulb and socket, it increases the ambient temperature of operation for the transformer, the igniter and the capacitor located thereabove.

In rating light fixtures for safe operation at a particular ambient temperature, Underwriters' Laboratory requires that all of the components of the fixture dissipate heat sufficiently for the fixture to be qualified for operation at that temperature. Because the annular spacing between the reflector and the socket generally impairs the heat dissipation capability of the capacitor, igniter and transformer, the chimney effect is only a partial solution to heat build up problems. It limits the ability of a fixture as a whole to achieve a higher temperature rating.

It is a primary objective of this invention to provide a light fixture which, compared to prior fixtures, achieves a higher temperature rating, thereby to extend the useful life and enable safer operation of all the components at higher ambient temperatures.

In the design of an electric light fixture, a number of other factors must also be considered. These other factors include pleasing aesthetics, ease in mounting and rebulbing, versatility in lamp wattage and line voltage and variation in the light distribution pattern. Each of these other features affects heat buildup, or heat generation. Generally, the higher the wattage of the bulb or the voltage of the line, the greater the amount of heat generated within the fixture. The amount of heat generated also depends upon the structural relationship among the necessary light fixture components, i.e., the volume of space occupied by the light fixture components and the density of the components within the given volume. Additionally, while the vertical position of a light reflector with respect to the bulb generally determines the light distribution pattern, the bulb is supported by a fixture which also houses the electrical components, and the distance between these electrical components and the reflector directly affects heat buildup. In all instances, a light fixture must dissipate heat with sufficient rapidity so as not to present a fire hazard.

In an attempt to meet independent, objective heat dissipation standards, as set by Underwriters' Laboratories, many light fixture designs have sacrificed factors such as aesthetic quality, versatility in light distribution adjustment and ease in mounting, maintaining and rebulbing.

It is an object of this invention to provide an electric light fixture with high heat dissipation capability without sacrificing other performance factors.

It is another object of the invention to provide an electric light fixture with enhanced heat dissipation capability and aesthetic quality.

It is still another object of the invention to provide an electric light fixture with enhanced heat dissipation capability and good selectability in achieving a desired light distribution pattern.

SUMMARY OF THE INVENTION

This invention contemplates a T-shaped fixture which supports a light bulb at a bottom end thereof and a reflector located around the light bulb. A midportion of the vertical part of the T-shape is configured to passively dissipate heat in four directions, i.e., outwardly along, or in the direction of the axis of the horizontal part of the T-shape and transversely thereto.

One aspect of this invention relates to an elongated, upper box-shaped housing which forms the horizontal part of the T-shape. The four vertical sides of this housing are slotted to promote heat removal therefrom. The slots are oriented vertically and diagonally to provide an aesthetically pleasing appearance for the fixture.

Another aspect of the invention relates to an intermediate component of the T-shaped fixture. This component is referred to as the coil cover. The coil cover includes a pair of opposing vertical sides which have a plurality of horizontal slots formed therein. The slots serve a dual purpose. They hold the reflector below and permit horizontally directed, outward heat flow from within the coil cover during operation, in the transverse direction.

The cover also includes two inclined surfaces which extend between the two opposing vertical sides of the coil cover. These inclined surfaces deflect heat away from the fixture along the longitudinal axis of the elongated, upper housing. Thus, the structural configuration of the fixture, and particularly the coil cover, promotes outward, passive heat dissipation in four directions.

According to a preferred embodiment of the invention, an electric light fixture includes a first elongated, box-shaped housing, a second box shaped housing, a coil cover, a cylindrical socket and a reflector with a pair of spaced, upwardly extending arms. The first elongated box shaped housing has a pair of sides with vertically oriented slots and a pair of sides with diagonally and vertically oriented sides. The first housing houses the igniter and the capacitor of the light fixture. A removable plate slidably connects to a top surface of the first housing. The removable plate also connects to a conduit, or mounting, through which electrical wires are routed to the fixture. The removable plate facilitates mounting of the fixture, and routing and electrically connecting the necessary electrical wiring to the fixture. The second housing resides below, and is mounted to the first housing. The second housing houses the transformer, often referred to as the ballast of the light. The coil cover is mounted to the bottom of the transformer. The socket is mounted to the bottom of the coil cover.

The coil cover includes an upper box-shaped portion and a lower portion. The upper portion includes a pair of opposing vertical sides, each with a plurality of horizontally oriented slots formed therein. Adjacent the bottom of these two opposing vertical sides, the lower portion includes two inclined surfaces which extend therebetween.

The reflector is spherical in shape and has a centrally formed aperture which may be oversized with respect to the cylindrical socket. The pair of spaced arms extend upwardly from opposite sides of the central aperture, and upper ends of the arms coact with a spaced pair of slots in the opposing pair of vertical sides to hang the reflector at a desired height relative to the socket.

With a light bulb threaded into the bottom end of the socket and electrical energy supplied thereto, heat generated thereby rises upwardly through an annular gap between the cylindrical socket and the reflector. Along the longitudinal axis of the fixture, the rising heat contacts the inclined surfaces and is directed outwardly from the fixture, along the longitudinal axis. Thereafter, it contacts the bottom of the first housing, and then flows up and around the housing to extract heat therefrom via the vents formed in the vertical walls thereof. Heat generated within the coil cover rises upwardly and outwardly and flows out of the coil cover horizontally through the horizontal slots in the opposing vertical sides of the coil cover. The structural configuration of the fixture produces a chimney effect, with heat flow upwardly through the reflector, then outwardly and finally along and away from the top of the fixture.

Because of the T-shape of this light fixture, the internal electrical components are substantially isolated from one another, thereby minimizing heat build up and maximizing heat dissipation. This enables the light fixture to be used for a wide range of line voltages and light bulb wattages. Moreover, regardless of the slots used to hang the reflector and to produce a desired light distribution, the generated heat will be sufficiently dissipated so as not to prevent a fire hazard. Finally, the T-shaped fixture provides high aesthetic quality.

These features will be more readily understood in view of the following detailed description.

BRIEF DESCRIPTION OF THE DRAWINGS

FIG. 11 is a perspective view of an electric light fixture in accordance with a preferred embodiment of the invention.

DETAILED DESCRIPTION OF THE DRAWINGS

Figure 1:
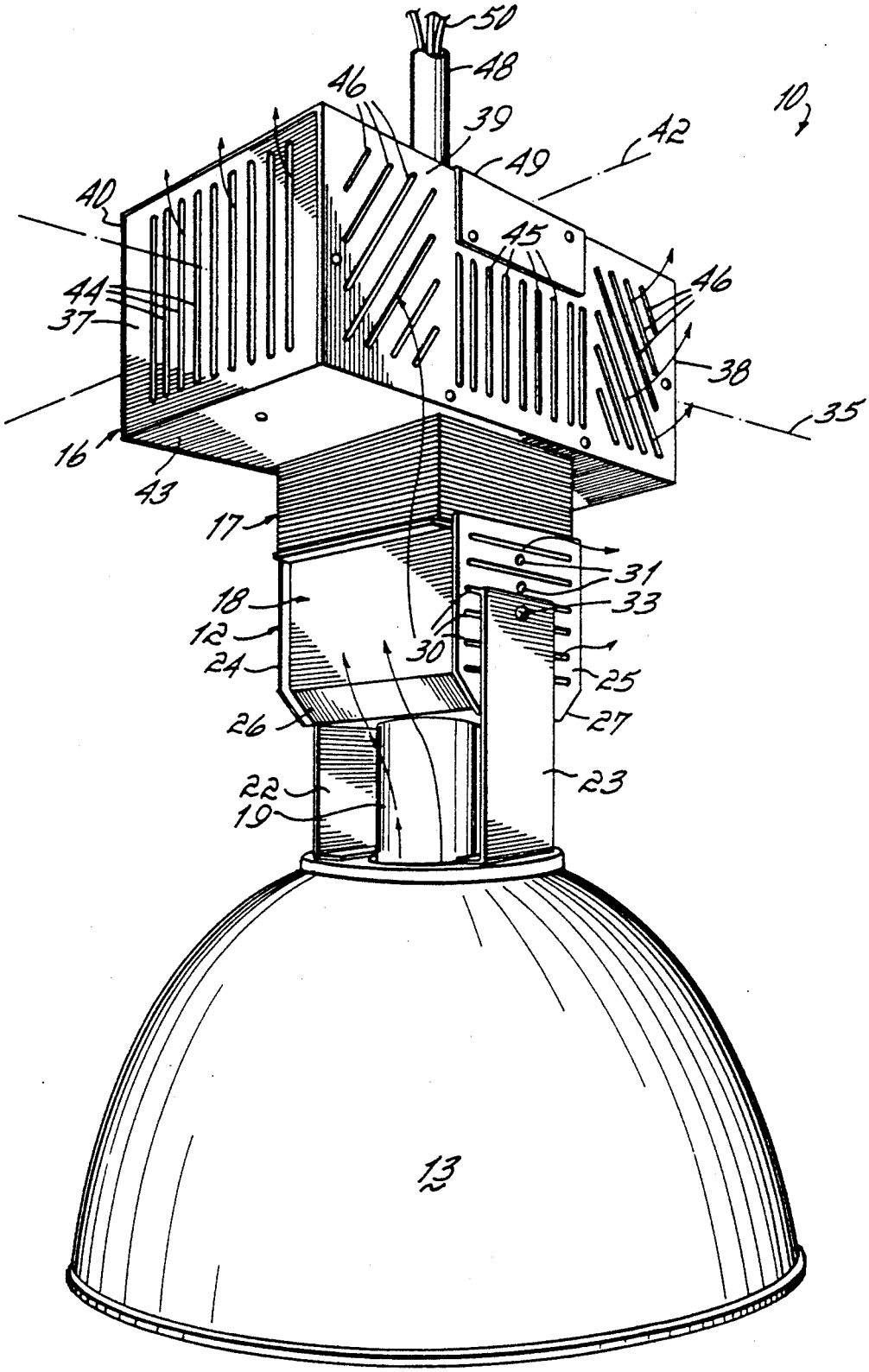
Figure 2:
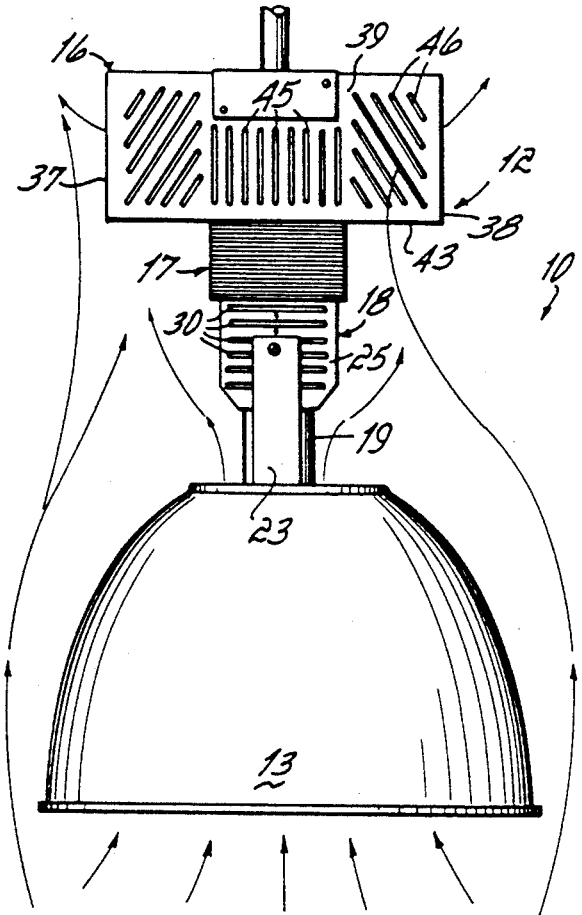
FIG. 2 is a right side view of the electric light fixture shown in FIG. 1
Figure 3:
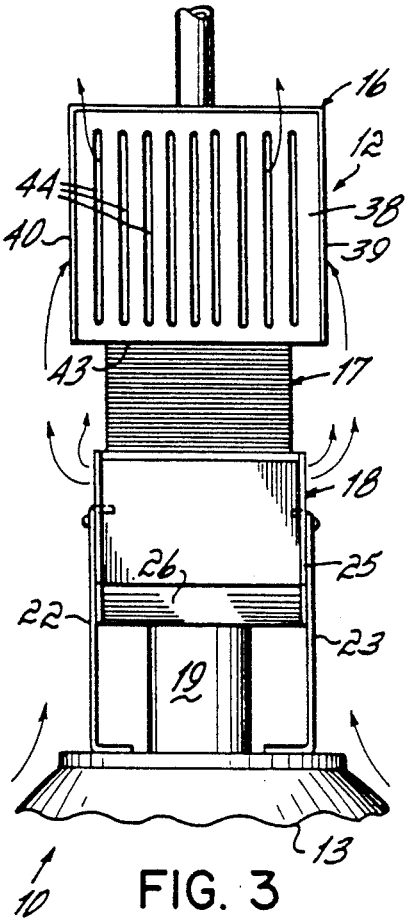
FIG. 3 is a left side view of the electric light fixture shown in FIG. 1.

FIGS. 1–4 show a preferred embodiment of an electric light fixture 10 according to the invention. The fixture 10 includes a generally T-shaped structure 12 which supports a reflector 13 adjacent a bottom end thereof. More particularly, the T-shaped structure 12 includes an upper, elongated box-shaped housing 16, a second box-shaped housing 17 mounted to the first housing 16, a coil cover 18 mounted to the bottom of the second box-shaped housing 17 and a cylindrically shaped, porcelain socket 19 mounted to the bottom of the coil cover 18.

The reflector includes a pair of spaced, upwardly extending arms 22 and 23 which connect to opposing vertical sides 24 and 25, respectively, of coil cover 18 to hang reflector 13 at a desired vertical position with respect to the cylindrical socket 19. Inclined surfaces 26 and 27 extend between opposing vertical sides 24 and 25. A plurality of horizontally oriented slots 30 in the opposing vertical sides 24 and 25 are sized to receive inwardly bent upper ends of reflector arms 22 and 23. Preferably, each slot 30 has a threaded aperture 31 located therebelow and sized to receive a screw 33 threaded inwardly from the outside of respective arm, 22 or 23, when it is inserted into the next adjacent slot 30 located thereabove. Preferably, the vertical dimension of the coil cover 18 is greater than the vertical dimension of housing 17. This helps to isolate the electrical components of the fixture 10 from an energized bulb in the socket 19.

The first, or upper, box-shaped housing 16 has an elongated parallelepiped shape, and the housing 16 is oriented along a longitudinal axis 35 through the fixture 10. This upper housing 16 has a pair of vertical side walls 37 and 38 facing outwardly along the longitudinal axis 35 and a pair of vertical side walls 39 and 40 facing outwardly transversely from longitudinal axis 35, along a transverse axis 42. A bottom surface 43 has no slots formed therein. Side walls 37 and 38 have vertically oriented slots 44 formed therein. Each of side walls 39 and 40 has a center section of vertically oriented slots 45 flanked by two outer sections of diagonally oriented slots 46. Preferably, housing 16 is made of 20 gauge industrial grade steel. Each of the side walls 37, 38, 39 and 40 has slots formed therein which comprise 15% of the total surface area thereof. The top surface of housing 16 has no slots, thereby to prevent dust from settling therein.

Figure 4:
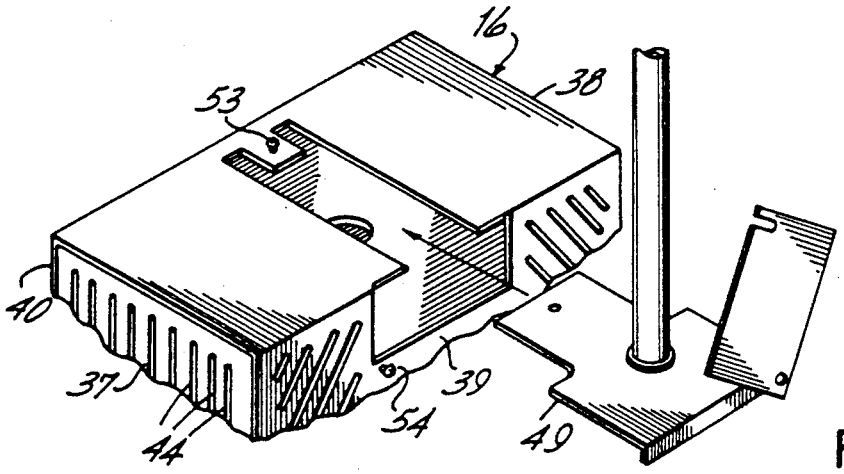
FIG. 4 is a perspective view of an upper portion of the electric light fixture shown in FIG. 1.

A cylindrical conduit 48, or mounting, has a top end attached to a ceiling or other support structure and a bottom end which connects to the top of housing 16. Preferably, the top of housing 16 includes a slidably removable plate 49 (FIG. 4). Electrical wires 50 extend through the conduit 48 and into first housing 16 to supply electrical energy to the socket. Typically, in mounting the fixture 10, electrical wires 50 and conduit 48 are already in place. One simply connects the plate 49 to the bottom of conduit 48, pulls the wires below the plate 49, connects the wires 50 to the electrical components of the fixture 10 and then slides the rest of the fixture 10 onto the plate 49. Preferably, the plate 49 is secured to housing 16 by screws 53 and 54.

This light fixture 10 is designed to accommodate high pressure sodium, metal halide, supermetal halide and mercury vapor lamp types. This fixture 10 is designed for use with a high power factor type CWA Class H, 60

Hz ballast. Generally, second housing 17 comprises the ballast for the fixture 10. This fixture 10 is designed to accommodate line voltages ranging from 120 volts up to 480 volts and lamp wattages of 35 watts up to 400 watts.

A number of different reflectors 13 may be used in conjunction with this fixture 10. Preferably, the reflector is an adjustable 16" diameter clear, ribbed prismatic acrylic material for glare control. If desired, a lens may be fitted to the bottom of the reflector. In most designs of this light fixture 10, the aperture in the reflector 13 is oversized with respect to the diameter of the cylindrical socket 19, thereby defining an annular gap therebetween when arms 22 and 23 are connected to coil cover 18. This gap promotes a "chimney effect" for the fixture 10 by enabling heat flow to pass upwardly through the annular gap so as not to build up within the reflector 13. However, in applications of this fixture 10 wherein a 175 watt metal halide bulb is operated at a line voltage of 250 volts, over-use eventually results in implosion of the bulb. Thus, it is required, for safety reasons, that there be no annular gap between the cylindrical socket 19 and the mounted reflector 13 so that the bulb is physically shielded from the other electrical components of the light fixture 10.

Horizontal slots 30 in cover 18 enable an operator to select the vertical position of the reflector 13 with respect to the socket 19. The relative position of the reflector 13 with respect to the socket 19 affects the light distribution pattern. If the bottommost pair of slots is chosen, the distribution patter will be smaller. If the uppermost pair of slots is chosen, the light distribution pattern will be greater. Therefore, slots 30 form a dual function, that of providing selectability for vertical positioning of the reflector 13 and promoting heat dissipation from within the bulb cover 18. Preferably, the slots 30 are spaced equidistantly and there is at least 2½" between the top and bottom slots.

In operation, the slots 30 heat flows outwardly from the coil cover 18 along axis 42 and away from the light fixture 10. Along longitudinal axis 35, heat flows upwardly from the annular gap adjacent the cylindrical socket 19 and into contact with inclined surfaces 26 and 27 where it is deflected outwardly from the fixture 10. The heat flow continues upwardly into contact with bottom surface 43 of housing 16, on both sides of second housing 17. Thereafter, the heat flow moves further upwardly and around the housing 16, thereby extracting heat from within housing 16 via slots 44, 45 and 46. Directional arrows 60 generally indicate heat flow from the light fixture 10 during operation.

When a new light bulb is required, an operator may simply reach up from under the reflector 13 to unscrew the old light bulb from its socket. If a lens is in place, or if it is desired to change the light distribution pattern, reflector 13 can be removed by unscrewing screws 33 and disconnecting arms 22 and 23. This provides direct access to the bottom end of the socket 19, and a new bulb can be substituted for the old one.

The structural configuration and orientation of the components of this light fixture 10 provide an aesthetically pleasing appearance, without any corresponding sacrifice in ease of mounting and maintaining the light, or reduction in selectability of the light distribution pattern.

More importantly, in addition to all of these factors, this fixture 10 also has enhanced heat dissipation capability, thus providing safer operation and longer life. This fixture 10 is listed by Underwriters Laboratories for 65° C. operation, which means that all of the physical and electrical components operate safely at any temperature below 65° C. Generally, for every 10° C. drop in coil rise temperature, the ballast life doubles. Thus, because this fixture 10 is listed for 65° C., when operated at 55° ambient, it offers double the life expectancy of outdated cast ballast designs.

While a preferred embodiment of the invention has been described, it is to be understood that various modifications could be made without departing from the spirit of the invention. Accordingly, it is to be understood that changes may be made without departing from the scope of the invention as particularly set out and claimed.

We claim:

1. A light fixture comprising:

a first box-shaped housing;

a second box-shaped housing mounted to a bottom of the first housing;

a cover mounted to a bottom of the second housing;

a cylindrical socket mounted to a bottom end of the cover;

a reflector located below the cover and having a central aperture;

a pair of spaced reflector arms extending upwardly from opposite sides of the reflector aperture and engaging an opposing pair of vertical sides of the cover to hang the reflector and locate a bottom end of the cylindrical socket within said aperture;

each of said opposing pair of vertical sides including slot means for venting the cover; and said cover having a pair of inclined surfaces extending between said pair of opposing vertical sides, whereby, when a light bulb is mounted and electrically energized in said socket, heat generated within the cover flows outwardly therefrom through the slot means on opposite sides of the fixture in a direction of a first axis, and heat generated by the light is also deflected away from the cover upon contact with the inclined surfaces, in a direction of a second axis.

2. The light fixture of claim 1 and further comprising:

venting means formed in four vertical sides of the first housing each of said four vertical sides having a predetermined total surface area.

3. The light fixture of claim 2 wherein said venting means comprises slots formed in each of the four vertical sides and the slots occupy about 15% of the surface area of each of the four vertical sides.

4. The light fixture of claim 2 and further comprising:

a first pair of opposing vertical sides of the first housing having vertically oriented slots formed therein; and a second pair of opposing vertical sides of the first housing having both vertically oriented and diagonally oriented slots formed therein.

5. The light fixture of claim 4 wherein each side of said second pair of vertical sides includes a central section of said vertically oriented slots residing between two outer sections of said diagonally oriented slots.

6. The light fixture of claim 1 wherein the first housing is elongated in the direction of the second axis so that outer ends thereof extend beyond said inclined surfaces, the first housing having four vertical sides, each of the sides having a plurality of slots formed therein, whereby heat deflected from the inclined surfaces flows upwardly into contact with a bottom surface of said first housing and then upwardly around the first housing to extract heat therefrom through the slots.

7. The light fixture of claim 1 wherein said slot means further comprises:

a plurality of spaced, horizontally oriented slots formed in each of said opposing pair of vertical sides of the cover, each of the slots sized to be engaged by a top end of a respective reflector arm, one slot of each of said opposing pair of vertical sides being selectively engaged by a respective reflector arm to hang the reflector to the fixture and the other unengaged slots providing heat flow passages to dissipate heat outwardly from the cover in a horizontal direction.

8. The light fixture of claim 1 wherein each of said cover and said second housing has a respective vertical dimension, and wherein the vertical dimension of the cover is greater than the vertical dimension of the second housing.

9. The light fixture of claim 1 and further comprising:

electrical energy supply means routed into the fixture at a top surface of the first housing and traversing the first housing, the second housing and the cover and terminating at the socket, thereby to supply electrical energy to the light mounted within the socket; and plate means removably connected to the top surface of the first housing to facilitate hanging of the fixture and routing of the electrical energy supply means to the fixture and therethrough to the socket.

10. The light fixture of claim 1 wherein the reflector aperture is oversized with respect to the cylindrical socket to define an annular gap therebetween.

11. A light fixture comprising:

a first box shaped housing elongated in a direction of a first axis, the first housing having slots formed in four vertical sides thereof and no slots in a bottom surface thereof;

a second box shaped housing mounted to the bottom surface of the first housing;

a cover mounted to a bottom surface of the second housing, the cover further including;

an upper box-shaped portion having an opposing pair of vertical sides facing outwardly from the first axis and in a direction of a transverse second axis, each of said pair of opposing vertical sides having a plurality of horizontally oriented slots formed therein, and a lower portion including two inclined surfaces extending between said opposing pair of vertical sides and facing outwardly in the direction of the first axis;

a cylindrical socket mounted to a bottom of the cover, the socket having a bottom end adapted to receive a light bulb therein;

a spherically shaped reflector having an aperture and mounted to the cover; and a pair of spaced reflector arms extending upwardly from opposite sides of the reflector aperture and engaging a pair of the slots in the cover in a selected horizontal plane, thereby to hang the spherically shaped reflector from the cover and centrally position the cylindrical socket within the aperture, whereby, when the light bulb is mounted within the bottom of the socket and electrically energized, heat generated within the cover flows outwardly therefrom in a horizontal direction through the slots and in the direction of the transverse axis, and heat rising adjacent the cylindrical socket deflects outwardly from the fixture in the direction of the first axis upon contacting the inclined surfaces, subsequently rises to contact the first housing bottom surface and then flows around the first housing to extract heat generated within the first housing through the four slotted sides.

12. The light fixture of claim 11 and further comprising:

a removable plate connected to an upper portion of the first box shaped housing, thereby to facilitate hanging of the fixture and routing of electrical energy supply means through the fixture to the socket.

13. The light fixture of claim 11 wherein the four sides of the first housing have vertically oriented slots and diagonally oriented slots to provide a high aesthetic quality to the fixture.

* * * * *